US006082146A

United States Patent [19]

Dahlgren

[11] Patent Number: 6,082,146

[45] Date of Patent: Jul. 4, 2000

[54] MOISTURE MANAGEMENT SOCK

[76] Inventor: Ray E. Dahlgren, 56 Corto Rd., Arcadia, Calif. 91006

[21] Appl. No.: 09/346,176

[22] Filed: Jul. 1, 1999

[51] Int. Cl.[7] ..... A41B 11/02

[52] U.S. Cl. ..... 66/185; 66/186; 66/187; 2/239

[58] Field of Search ..... 2/239, 272, DIG. 1; 66/182–188, 200–202

[56] References Cited

U.S. PATENT DOCUMENTS

| | | | |
|---|---|---|---|
| 4,898,007 | 2/1990 | Dahlgren | 66/185 |
| 5,095,548 | 3/1992 | Chesebro, Jr. | 2/239 |
| 5,353,524 | 10/1994 | Brier | 36/55 |
| 5,511,323 | 4/1996 | Dahlgren | 36/3 A |
| 5,708,985 | 1/1998 | Ogden | 2/239 |
| 5,724,836 | 3/1998 | Green | 66/185 |

*Primary Examiner*—John J. Calvert
*Assistant Examiner*—Robert H. Muromoto, Jr.
*Attorney, Agent, or Firm*—Shapiro Buchman Provine & Patton LLP; Mitchell S. Rosenfeld

[57] ABSTRACT

An improved sock wherein moisture distribution, wicking, evaporation and other phases of control are all managed by the sock construction. The moisture management sock has a toe portion knit of predominantly of hydrophilic yarn; a heel portion knit of predominantly of hydrophilic yarn; and alternating rings of hydrophobic and hydrophilic yarn located between said toe portion and said heel portion. Moisture absorbed from the wearer's foot by the hydrophilic yarn is transferred by wicking action into the hydrophobic rings and then to the leg portion to be evaporated therefrom.

5 Claims, 3 Drawing Sheets

MOISTURE MANAGEMENT SOCK

TECHNICAL FIELD

This invention relates generally to dress and sport casual socks, and more particularly to an improved sock in which moisture distribution, wicking, evaporation and other phases of control, as well as stretch and cushioning, are all managed by the sock construction.

BACKGROUND ART

The moisture that occurs or develops in the foot area is necessary and healthful; however it is also uncomfortable, in excess. On average, after a foot is in a shoe for 10 minutes, the temperature in the shoe will reach approximately 105 degrees Fahrenheit. Moreover, in a typical day, a foot in a dress shoe may produce 2–4 ounces of moisture inside the shoe. Currently it has been the practice to rely upon hydrophobic (i.e. non absorbent) yarn worn against the skin to remove moisture away from the skin. Hydrophobic yarns consisting of synthetic resinous material (petroleum based) are non-absorbent, and can result in an uncomfortably wet sock condition underfoot due to impeded air flow and heat retentive characteristics of the yarn. In contrast, the typical dress or sport casual sock is formed entirely of hydrophilic (i.e., absorbent) yarn, such as cotton or wool, to provide maximum comfort. However, the hydrophilic yarn retains the moisture rather than removing he moisture away from the skin. Thus, there is need for an improved sock in which moisture collection and disposition are better managed.

One such solution is provided by U.S. Pat. No. 4,898,007, entitled Moisture Management Sock issued to the same inventor as the present invention and is incorporated herein by reference. The '007 patent provides a sock construction utilizing a combination of hydrophilic and hydrophobic yarn zones. This construction is especially suited for athletic activities in which the wearers' foot generates a large amount of moisture that must be wicked and evaporated. In particular, the toe and heel portions are knit predominantly, or entirely, of hydrophilic yarn while the instep portion extending therebetween is knit of hydrophobic yarn so that moisture absorbed from the wearer's foot by the hydrophilic yarn in the toe portion is transferred by wicking action into the hydrophobic yarn in the instep portion and then to the leg portion to be evaporated therefrom.

However, the amount of hydrophobic yarn required still causes heat retention, especially for dress and sport casual applications. If too much hydrophobic yarn is used, the hydrophobic yarn will cause the foot to generate more moisture than the hydrophobic yarn can remove, and thus the sock becomes ineffective. Heat retention is especially problematic in dress shoes. Within the enclosed environment of a shoe there is very little air flow—even less in dress shoes as most athletic shoes are usually vented. Yet dress shoes are commonly worn for longer periods of time than athletic shoes. Thus, there is as great if not greater need for efficient moisture control in a dress or sport casual sock than an athletic sock.

SUMMARY OF THE INVENTION

The present invention improves upon the '007 patent by providing a construction more suitable for moisture management needs of dress and sport casual socks rather than ataletic socks.

More particularly, the present invention provides an improved moisture management sock through the use of alternating hydrophilic and hydrophobic rings in the foot portion of the sock.

In accordance with the illustrated preferred embodiment, the present invention provides a novel, cost effective moisture management dress and sport casual sock.

It is a major object of the invention to provide an improved sock meeting the above described moisture management needs in a dress or sport casual sock. The concept upon which the invention is based is the use of both hydrophilic and hydrophilic yarn in a sock, to first absorb or dry-off the skin, locally, using hydrophilic yarn, and thus to remove or transfer the moisture from the hydrophilic to hydrophobic yarn and to an area where evaporation can more readily take place.

It is another object of the invention to provide a moisture management sock that has low heat retention and high moisture removal capability.

Yet another object of the invention is :o provide a moisture management sock that is more subtle in appearance for dress and sport casual applications than for athletic applications.

The moisture management sock of the present invention includes, briefly, a toe portion knit of predominantly of hydrophilic yarn; a heel portion knit of predominantly of hydrophilic yarn; and alternating rings of hydrophobic and hydrophilic yarn located between said toe portion and said heel portion. Moisture absorbed from the wearer's foot by the hydrophilic yarn is transferred by wicking action into the hydrophobic rings to be evaporated therefrom.

The present invention has other objects and advantages which are set forth in the description of the Best Mode of Carrying Out the Invention. The features and advantages described in the specification, however, are not all inclusive, and particularly, many additional features and advantages will be apparent to one of ordinary skill in the art in view of the drawings, specification, and claims herein.

DETAILED DESCRIPTION OF BEST MODE OF CARRYING OUT THE INVENTION

Figure 1:
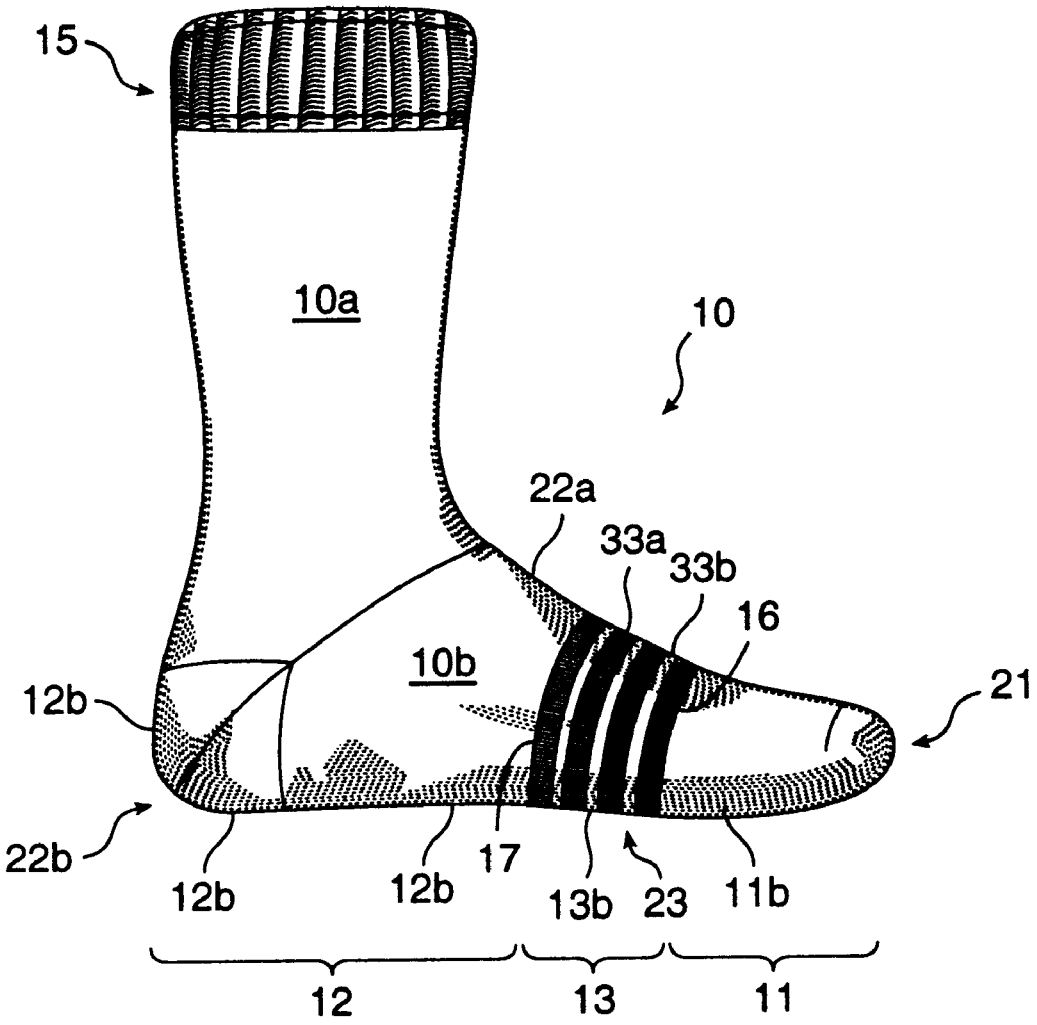
FIG. 1 is a side elevational view showing a sock embodying the invention.

The moisture management sock of the best mode of the invention is constructed predominantly of hydrophilic yarn except for a series of hydrophobic rings of yarn alternating with a series of hydrophilic rings of yarn in the foot portion of the sock. The sock has the following yarn zones:

(i) a first zone 11 at the toe of the sock wherein the yarn is predominately hydrophilic, (ii) a second zone 12 ranging from the open end in the leg portion to the instep (and including the heel) of the sock wherein the yarn is predominately hydrophilic, and (iii) a third zone 13 at the ball of the foot between the first and second zones wherein the yarn is woven in alternating rings of hydrophobic and hydrophilic yarn.

As a result, moisture absorbed from the wearer's foot by the yarn at the first zone is transferred by wick action into the yarn at the third zone, for such ready removal, as by evaporation in the second zone. As will be seen, the yarn at the first, second and third zones have lower sections engageable with the bottom of the wearer's foot, said yarn sections having the form of a cushioned terry knit. Also, the yarn at all three zones preferably includes synthetic resin binder yarn for form and fit and to serve as a backing for the terry knit; and the yarn at the first and second zones preferably includes hydrophilic yarns such as cotton in an amount between 50 and 100 percent of the total yarn at the first and second zones. The synthetic resin typically comprises Nylon. Considering that sweat glands of the foot are concentrated at the toe and heel area, the following qualities are taken into account and provided:

(1) Evaporation—Acrylic (such as Creslan or Orlon) is preferably employed as a component of the hydrophobic yarn or yarns, for evaporative, transference of moisture, fit, and good adherence.

(2) Absorption and Comfort—Wool or cotton is employed as the hydrophilic yarn due to its ability to absorb a large percentage of its weight in moisture (wool 12–13%; cotton 6–7%); also, such yarns do not irritate the skin and are not clammy or sticky, and each is a "breathing" fabric that does not create or concentrate heat, and it can be easily sanitized. The acrylic or hydrophobic yarns are not used in predominance throughout the sock in order to obtain maximum moisture absorptive qualities and benefits of hydrophilic yarns without creating or concentrating heat, as in related moisture.

The alternating hydrophobic and hydrophilic rings create a push-pull effect (i.e., capillary action) which effectively and rapidly draws moisture from the hydrophilic yarn in first zone 11 to the hydrophobic rings. This creates an effect similar to the wick and flame of a lantern, where the flame draws the kerosene through the wick to the area of combustion. Heat from the foot that comes into contact with the hydrophobic rings in third zone 13 acts as the flame to draw the moisture away from the hydrophilic rings and toe portion in first zone 11 which acts as the wick by absorbing and serving as a conduit for the moisture.

Since the hydrophobic rings are enclosed in the shoe, evaporation is prevented at this point. Typical dress and sport casual socks do not have venting holes proximate to third zone 13 to allow for evaporation. Thus, the moisture continues to travel towards the evaporation area 44 in the leg of the sock in second zone 12 outside of the shoe 42.

The rings reduce the amount of hydrophobic yarn required to wick the moisture, which reduces the heat retentiveness of the sock, without significantly reducing the socks ability to wick and evaporate moisture. The hydrophilic rings reduce the heat retentiveness of third zone 13 by replacing heat retentive hydrophobic yarn with "breathing" hydrophilic yarn. Thus, the use of alternating hydrophobic and hydrophilic rings reduces the temperature inside a surrounding shoe.

For light activities (e.g., a dress sock) only a small amount of moisture needs to be wicked and evaporated therefor, only a small amount of hydrophobic material is needed in the sock. Thus, in dress socks, narrow hydrophobic rings are employed. For heavier activities (e.g., a golf sock), more moisture is generated, therefor, thicker hydrophobic rings are employed. The heavier the intended activity, the thicker the hydrophobic rings. Additionally, the width of the hydrophobic rings may also vary by the intended climate. The hotter the intended climate, the more moisture the foot will generate, and thus the wider the hydrophobic rings. Regardless of the width of the hydrophobic rings, it is preferred that the width of the hydrophilic and hydrophobic rings are equal.

The narrow hydrophilic rings work with the hydrophobic rings to create the capillary action by providing a sufficiently small distance between the hydrophobic rings to allow moisture to rapidly transfer from the outer hydrophobic rings to the inner hydrophobic rings. If the width of the hydrophilic rings is too great, the distance will impede the moisture transfer process.

The alternating hydrophobic and hydrophilic rings (zone 13) are located at the ball of the wearer's foot. This location is ideal as it is closest to toe portion 11 where the majority of the moisture is created. Although, moisture is also created at the heel portion, in dress and sport casual, the greatest concern is the moisture created at the toe portion 11. The moisture from the heel will move towards the leg of the sock outside of the shoe where it can easily evaporate due to the low height of dress and sport casual shoes. The alternating hydrophobic and hydrophilic rings (zone 13) wick moisture from the toe portion. The moisture will then be drawn up the sock to the leg portion outside of the shoe where evaporation is most effective.

Additionally, a "framework" of Nylon, i.e. "binder yarn" is employed on the outside of the sock, leaving the terried hydrophilic yarn against the foot as at the heel and toe, providing fit, stretch memory, and a backing for the terry knit. Whereas Acrylic (synthetic fiber) is typically used in hydrophobic areas of the sock, it is not employed at the first and second zones in order to enhance the hydrophilic effect of the cotton or wool yarn at those areas. A cushioned terry knit may be employed along the entire bottom of the sock, from the toe to the heel, but the cushion is not used over the instep to allow for more effective evaporation of moisture absorbed by the hydrophilic yarn.

The framework is not necessary if a terry knit is not used and the sock is not stretchable (i.e., one size fits all type). If the framework is not used, which may be the case for some dress socks, the first zone 11, second zone 12 and hydrophilic rings of the third zone 13 are woven solely out of hydrophilic yarn and thus are 100% hydrophilic.

Referring first to FIG. 1, a knit sock 10, in which foot moisture is managed by the sock knit construction, including three basic yarn zones:

(i) a cup-shaped first zone at the toe portion 21 of the sock 10 (see for example zone 11) wherein the yarn is predominately and relatively hydrophilic, i.e. characterized as tending to absorb moisture from the toe area of the wearer's foot, and particularly the underside of the wearer's toes which the sock supports and cushions, and to distribute moisture to the third zone to be described;

(ii) a larger tubular-shaped second zone 12 ranging from the open end 14 of leg portion 10*a* of sock 10 to instep portion 22*a* (including heel portion 22*b*) of the sock (see for example zone 12) wherein the yarn is predominately hydrophilic, i.e. characterized as tending to absorb moisture from the heel and instep area of the wearer's foot, and particularly the underside of the wearer's heel which sock 10 supports and cushions, and also to evaporate moisture from the third zone to be described;

(iii) a generally tubular third zone at ball portion of sock 10 (see for example zone 13) between zones 11 and 12 wherein the yarn is woven in alternating rings 33 of hydrophobic 33*a* and hydrophilic 33*b* yarn, and to transfer by capillary action such moisture received from first zone 11 with normal action of the foot to evaporation area 44 of leg portion 10*a* which is not enclosed within shoe 42.

Figure 2:
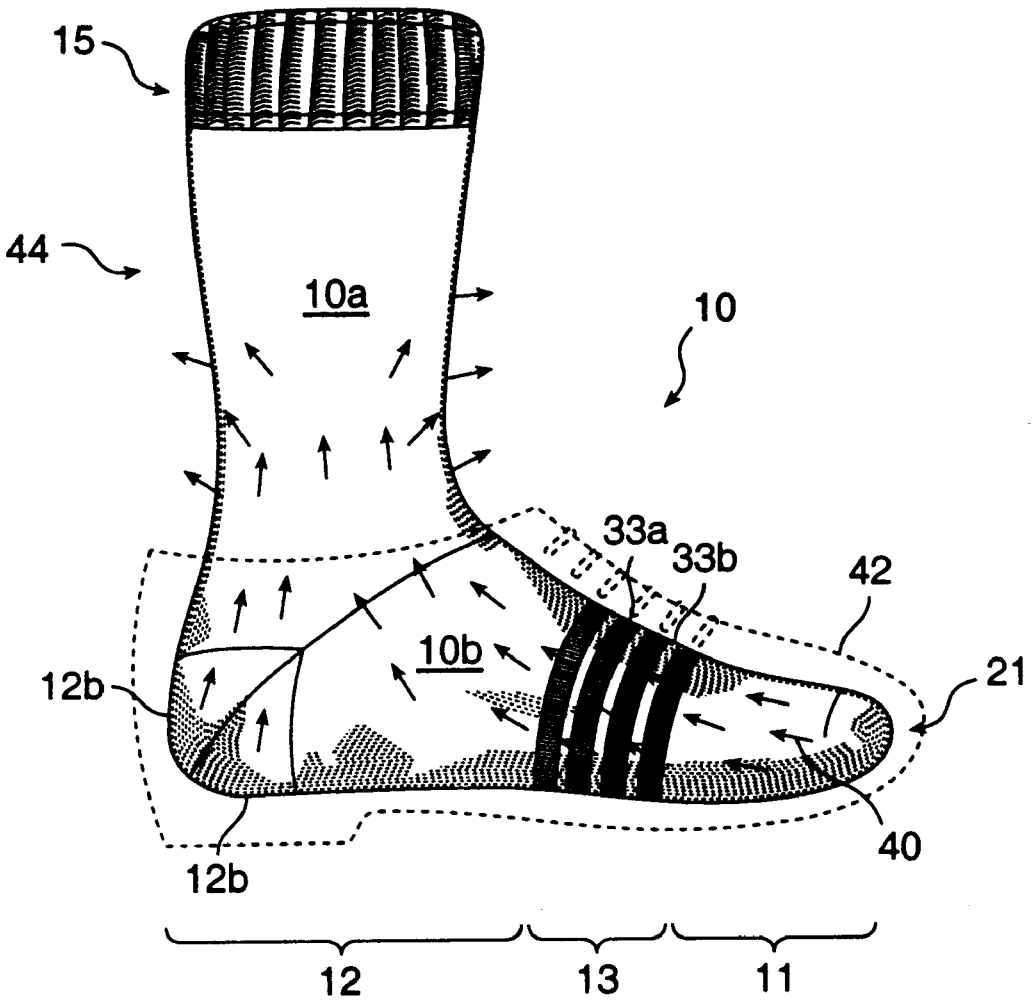
FIG. 2 is a side elevational view illustrating the movement of moisture in a sock embodying the invention.

The travel of moisture in sock 10 is illustrated in FIG. 2 by arrows 40. Moisture is pulled from toe portion 21 by rings 33. The moisture continues to migrate to the Evaporation area 44 of leg portion 10*a* outside of shoe 42. Moisture does not evaporate in other areas of sock 10 since these areas are confined within shoe 42. Hydrophobic material may be added to leg portion 10*a* to enhance the wicking and evaporation in evaporation area 44, however, this modification increases manufacturing costs and is not necessary for the typical dress and sport casual application.

The preferred width of the hydrophobic and hydrophilic rings 33 vary from approximately 1/16 inch to approximately ½ inch. The most preferred widths are approximately ⅛ inch for a dress sock and approximately ¼ inch for a sport casual sock. Preferably, the width of the hydrophobic and hydrophilic rings 33 are equal, or at least substantially equal.

Although the number of rings 33 may vary, 4–6 hydrophobic rings 33*a* are preferred. The thinner the rings employed, the greater the number of rings that are employed. Moreover, rings 33 may be located elsewhere in foot portion 10*b*, even within leg portion 10*a*. However, ball portion 23 is the preferred location as it is closest to toe portion 21 where the majority of the moisture is generated by the wearer's foot.

As shown, zone 11 is contiguous and joined edgewise or coursewise to zone 13 at lower looping oval edge 16 extending about the sock forward of the instep; and zone 12 is contiguous and joined edgewise or a coursewise to zone 13 at upper looping oval edge 17. Yarns at the zones 11–13 have lower sections 11*b* (toe), 12*b* (heel and instep), and 13*b* (ball) engageable with the bottom of the wearer's foot. Sections 11*b*, 12*b* and 13*b* typically have the form of a cushioned or padded terry knit yarn, for extra comfort.

FIG. 1 also shows a sock upper tubular and cushioned portion 15 within leg portion 10*a* to fit about the wearer's lower leg, and which also consists of hydrophilic yarn.

Figure 3:
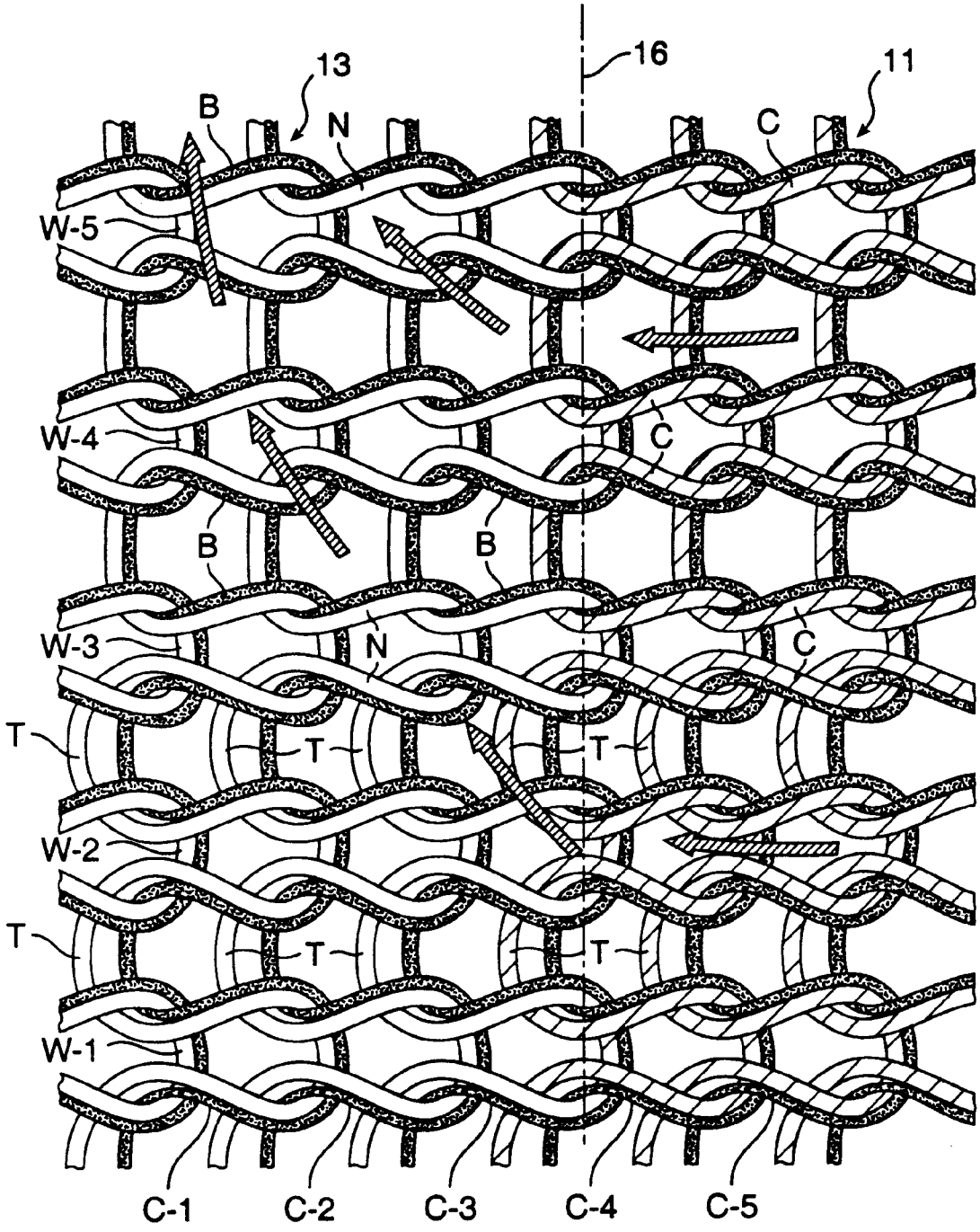
FIG. 3 is a greatly enlarged view of the stitch loop construction in the area of the central portion of the line 16 in FIG. 1.

As shown in the portion of knit fabric of FIG. 3, needle wales W-3, W-4 and W-5 are located in the upper half of the foot and needle wales W-l and W-2 are located in the lower half or sole of the foot. The portion of the knit fabric in courses C-1, C-2 and C-3 is located in the hydrophobic rings 33*a* of zone 13 and to the left of the edge 16 while the courses C-4 and C-5 are located in the toe portion 21 of first zone 11. If sock 10 is terried or stretchable, the entire sock 10 is knit throughout of a hydrophobic binder or body yarn B while additional hydrophilic yarn C (striped in FIG. 2) is knit in plated relationship with the body yarn B in the first and second zones 11, 12, and additional hydrophobic yarn N (plain in FIG. 2) is knit in plated relationship with the body yarn B in the hydrophobic rings 33*a* of third zone 13. As shown, terry loops T are formed of the yarns C and N in the sinker wales between the needle wales W-1, W-2 and W-2, W-3.

In either athletic, leisure, or dress type socks, the hydrophobic body yarn B forms a base or ground fabric and is much smaller than the additional hydrophobic yarn N and the additional hydrophilic yarn C. For example, in an athletic type sock, it is preferred that the body yarn B be a textured stretch nylon of two ply, 100 denier (total of 200 denier), the additional hydrophobic yarn N be an acrylic, such as Creslan, of two ends, 24 single count (equivalent to 443 denier), and the additional hydrophilic yarn C be a 12 single count cotton yarn (equivalent to 443 denier). In this particular example, the amount of the hydrophobic body yarn B is substantially one-half the amount of the hydrophilic yarns C in the first and second zones 11, 12 and the hydrophobic yarn N in the third zone 13.

Thus, the first and second zones 11, 12 and the hydrophilic rings 33*b* of third zone 13 are knit predominately of hydrophilic yarn while the hydrophobic rings 33*a* of third zone 13 are knit entirely of hydrophobic yarn. Opposite ends of the third zone 13 are joined edgewise or coursewise to the adjacent ends of the corresponding first and second zones 11, 12 so that moisture absorbed from the wearer's foot by the predominately hydrophilic yarn C in the first and second zones 11, 12 is transferred by wicking action into the predominately hydrophobic yarn N in the third zone 13 to be evaporated therefrom, as indicated by the arrows in FIG. 3, showing the path of travel of the moisture from the first zone 11 to the third zone 13. As shown in FIG. 1, the toe portion 11 also includes an adjacent portion of the foot of the sock which is adapted to engage and underlie the ball of the wearer's foot. This ball portion is also knit predominately of the hydrophilic yarn C.

While the hydrophobic body yarn B is knit throughout the sock, for the purpose of providing sufficient stretch to the sock to fit a range of foot sizes, it is to be understood that the sock can be knit without a body yarn. In this instance, the first zone 11, the second zone 12 and hydrophilic rings 33*b* will be knit entirely of hydrophilic yarn C and hydrophobic rings 33*a* will be knit entirely of the hydrophobic yarn N. Thus, when the first zone 11, the second zone 12 and hydrophilic rings 33*b* are described as being knit predominately of the hydrophilic yarn, this is intended to also mean that these zones can be knit entirely of the hydrophilic yarn as indicated in the TABLE below where the zones 11 and 12 and hydrophilic rings 33*b* are indicated as being knit of 100% hydrophilic yarn and the hydrophobic rings 33*a* are indicated as being knit of 100% Nylon or Creslan (hydrophobic) yarn.

The yarn at all three zones 11, 12 and 13 is knit in plated relationship with the synthetic resin birder or body yarn to enhance fit and to serve as a backing for terry knit; and the yarn at the first and second (hydrophilic) zones 11 and 12 and hydrophilic rings 33*b* typically includes Cotton or wool in an amount between 50 and 100 percent of the total yarn at first and second zones 11 and 12 and hydrophilic rings 33*b*. Typically, there is little or no cotton yarn in hydrophobic rings 33*a*. The cotton yarn is knit with the synthetic resin binder or body yarn, using conventional knitting machines and plating processes, and most desirably, the amount of hydrophilic yarn is about 75 percent of the total yarn at zones 11 arid 12 and hydrophilic rings 33*b*.

The synthetic resin binder or body yarn at all zones most desirably includes resiliently stretchable Nylon, or equivalent; and the synthetic resin yarn in hydrophobic rings 33*a* most desirably includes Acrylic yarn, or equivalent, in amounts substantially greater than the Nylon yarn in hydrophobic rings 33*a*.

The following TABLE shows the yarn proportions:

| Zones | Yarn | Range (%) | Preferred Sport Casual (%) | Preferred Dress (%) |
|---|---|---|---|---|
| 11, 12 & 13 (hydrophilic rings) | Hydrophilic | 50–100 | 100 | 100 |
| 13 (hydrophobic rings) | Nylon | 50–0 | 0 | 0 |
| | Creslan | 50–100 | 100 | 100 |

In the above, the Nylon binder or body yarn is a resiliently stretchable, i.e. elastic, yarn, whereby the sock will stretch to closely fit a wide range of foot sizes. If the sock is not to be stretchable, Nylon binder or body yarn may be omitted, i.e. all synthetic yarn may consist of Creslan, or equivalent.

From the above description, it will be apparent that the invention disclosed herein provides a novel and advantageous moisture management sock. The foregoing discussion discloses and describes merely exemplary methods and embodiments of the present invention. One skilled in the art will readily recognize from such discussion that various changes, modifications and variations may be made therein without departing from the spirit and scope of the invention. Accordingly, disclosure of the present invention is intended to be illustrative, but not limiting, of the scope of the invention, which is set forth in the following claims.

I claim:

1. A moisture management sock including a foot portion comprising a toe portion, a heel portion, an instep portion, and a ball portion positioned between said toe and instep portions, said foot portion having the following yarn zones:

a first zone comprising said toe portion, and wherein said first zone is knit predominately of hydrophilic yarn, a second zone comprising said instep portion and said heel portion, and wherein said second zone is knit predominately of hydrophilic yarn, and a third zone comprising said ball portion and being joined edgewise with said first and second zones, and wherein said third zone is knit predominately of alternating rings of hydrophilic and hydrophobic yarn, wherein the rings are substantially of equal width, and whereby moisture absorbed from the wearer's foot by the hydrophilic yarn in said first zone is transferred by wicking action into the rings of hydrophobic yarn in said third zone.

2. The moisture management sock according to claim 1 wherein said first, second and third zones include lower sections engageable with the bottom of the wearer's foot, and including terry loops extending inwardly from said lower sections and adapted to engage the bottom of the wearer's foot.

3. The moisture management sock according to claim 1, wherein said second zone further comprising a leg portion connected to said foot portion.

4. A moisture management sock including a foot portion for covering a wearer's foot, said moisture management sock comprising:

a toe portion located within said foot portion and knit of predominantly of hydrophilic yarn;

a heel portion located within said foot portion and knit of predominantly of hydrophilic yarn; and alternating rings of substantially equal width of hydrophobic and hydrophilic yarn located within said foot portion between said toe portion and said heel portion.

5. The moisture management sock according to claim 4 wherein said foot portion includes lower sections engageable with the bottom of the wearer's foot, and including terry loops extending inwardly from said lower sections and adapted to engage the bottom of the wearer's foot.

* * * * *